US006204600B1

(12) United States Patent
Park et al.

(10) Patent No.: US 6,204,600 B1
(45) Date of Patent: Mar. 20, 2001

(54) FIELD EMISSION DEVICE HAVING FLOATING ELECTRODE AND CONDUCTIVE PARTICLE LAYER

(75) Inventors: Deuk-il Park, Suwon; Jong-seo Choi, Anyang, both of (KR)

(73) Assignee: Samsung Display Devices Co., Ltd., Kyungki-do (KR)

( * ) Notice: Subject to any disclaimer, the term of this patent is extended or adjusted under 35 U.S.C. 154(b) by 0 days.

(21) Appl. No.: 09/174,654

(22) Filed: Oct. 19, 1998

(30) Foreign Application Priority Data

Oct. 22, 1997 (KR) ..... 97-54213

(51) Int. Cl.[7] ..... H01J 1/62; H01J 63/04

(52) U.S. Cl. ..... 313/496; 313/497; 313/306; 313/307; 313/311

(58) Field of Search ..... 313/496, 497, 313/495, 306, 309, 310, 311, 307, 483, 351, 355

(56) References Cited

U.S. PATENT DOCUMENTS 5,455,597 * 10/1995 Nakamura et al. ..... 313/497
5,932,963 * 8/1999 Nakamura et al. ..... 313/495
6,005,334 * 12/1999 Mitome et al. ..... 313/309
6,043,605 * 3/2000 Park ..... 313/586

FOREIGN PATENT DOCUMENTS 0 675 517 10/1995 (EP) .
97 11476 3/1997 (WO) .

* cited by examiner

*Primary Examiner*—Michael H. Day
*Assistant Examiner*—Mariceli Santiago
(74) *Attorney, Agent, or Firm*—Lowe Hauptman Gilman & Berner, LLP

(57) ABSTRACT

A field emission device includes a substrate, a first electrode formed on the substrate in a predetermined pattern, a dielectric layer formed on the substrate to embed the first electrode, a second electrode formed on the dielectric layer in a predetermined pattern, a floating electrode spaced apart a predetermined distance from the second electrode, on the dielectric layer, and a conductive particle layer formed between the second electrode and the floating electrode to electrically connect the second electrode and the floating electrode.

6 Claims, 2 Drawing Sheets

FIELD EMISSION DEVICE HAVING FLOATING ELECTRODE AND CONDUCTIVE PARTICLE LAYER

BACKGROUND OF THE INVENTION

1. Field of the Invention

The present invention relates to a field emission device and an image display device using the same.

2. Description of the Related Art

In order to find a substitute for the existing cathode ray tube (CRT), there has been vigorous research into development of flat panel displays, and the flat panel displays are being extensively developed to apply the same to a wall television and an image display for a high definition television (HDTV). Such flat panel displays include a liquid crystal device, a plasma display panel and a field emission device. Among those, much attention has been paid to the field emission device due to its brightness and low power consumption.

The conventional field emission device includes a cathode layer formed on a substrate in a predetermined pattern, microtips formed on the cathode layer, an insulation layer formed on the cathode layer to expose the microtips, and a gate electrode having an aperture exposing the microtips on the insulation layer.

If a predetermined voltage is applied between anodes (not shown) installed over the gate electrodes and microtips in a state where the microtips are grounded, electrons are emitted from the microtips. The field emission device has a short life because the microtips are susceptible to damage due to ion collision. Also, much electricity is consumed due to a high voltage for forming an electric field. A large amount of Joule heat is generated during electron emission, which may cause thermal deterioration of the device.

FIG. 1 illustrates an example of an image display device using a field emission device proposed for solving the problems of the conventional art.

As shown in FIG. 1, first and second electrodes 12 and 13 are formed to be spaced a predetermined distance apart from each other on the top surface of a rear substrate 11. Thin layers 14*a* and 14*b* formed of PdO are coated on the first and second electrodes 12 and 13, respectively. Also, a transparent front substrate 15 is coupled over the rear substrate 11 to form a free space for electron movement between the same and the rear substrate 11. A phosphor layer 16 and an accelerating electrode layer 17 are sequentially formed on the bottom surface of the front substrate 15.

In the operation of the field emission device 10 constructed as described above, a high voltage is applied to the accelerating electrode layer 17 and a predetermined voltage is applied to the first and second electrodes 12 and 13, so that electrons emitted between the thin layers 14*a* and 14*b* coated on the respective electrodes 12 and 13 are accelerated toward the accelerating electrode layer 17 to make the phosphor layer 16 luminesce.

However, the conventional field emission device has disadvantages in that it is difficult to maintain a small distance between thin layers 14*a* and 14*b*, for example to 10 nm, and there is a limit in selecting materials for forming thin layers and electrodes. Also, due to a complicated process for forming the thin layers, a large-screen image display device is difficult to fabricate.

SUMMARY OF THE INVENTION

To solve the above problems, it is an objective of the present invention to provide a field emission device which can reduce the driving voltage and can be fabricated to be large, and a display device employing the same.

Accordingly, to achieve the above objective, there is provided a field emission device including a substrate, a first electrode formed on the substrate in a predetermined pattern, a dielectric layer formed on the substrate to embed the first electrode, a second electrode formed on the dielectric layer in a predetermined pattern, a floating electrode spaced apart a predetermined distance from the second electrode, on the dielectric layer, and a conductive particle layer formed between the second electrode and the floating electrode to electrically connect the second electrode and the floating electrode.

The conductive particle layer is formed by hardening a paste containing conductive particles so that the conductive particles are dispersed and spaced apart from one another.

Preferably, the capacitance between the first electrode and the floating electrode is greater than that between the first electrode and the second electrode.

According to another aspect of the present invention, there is provided a display device comprising a field emission device including a substrate, a first electrode formed on the substrate in a predetermined pattern, a dielectric layer formed on the substrate to embed the first electrode, a second electrode formed on the dielectric layer in a predetermined pattern, a floating electrode spaced apart a predetermined distance from the second electrode, on the dielectric layer, and a conductive particle layer formed between the second electrode and the floating electrode to electrically connect the second electrode and the floating electrode; and a front substrate coupled in front of the substrate to form a space for electron emission with the substrate and having a phosphor layer and an accelerating electrode layer sequentially formed in its inner surface.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENTS

Figure 1:
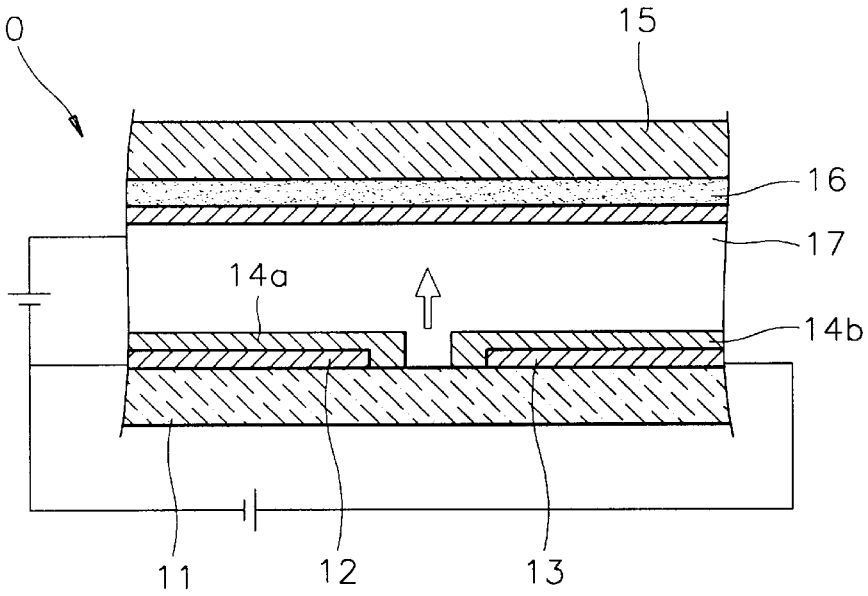
FIG.1 (PRIOR ART)
FIG. 1 is a cross-sectional view illustrating a display device using a conventional field emission device.
Figure 3:
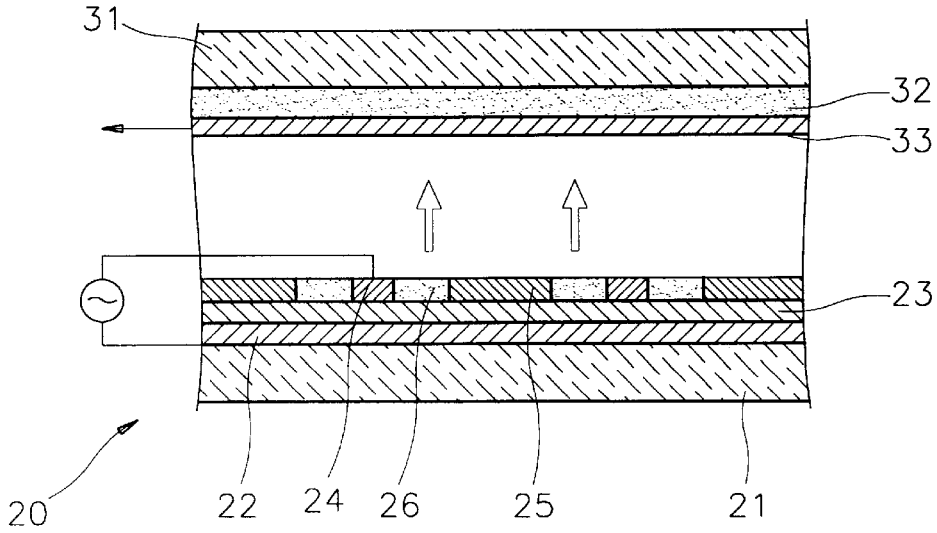
FIG. 3 is a partly cut-away cross-sectional view illustrating a display device using a field emission device according to the present invention.
Figure 2:
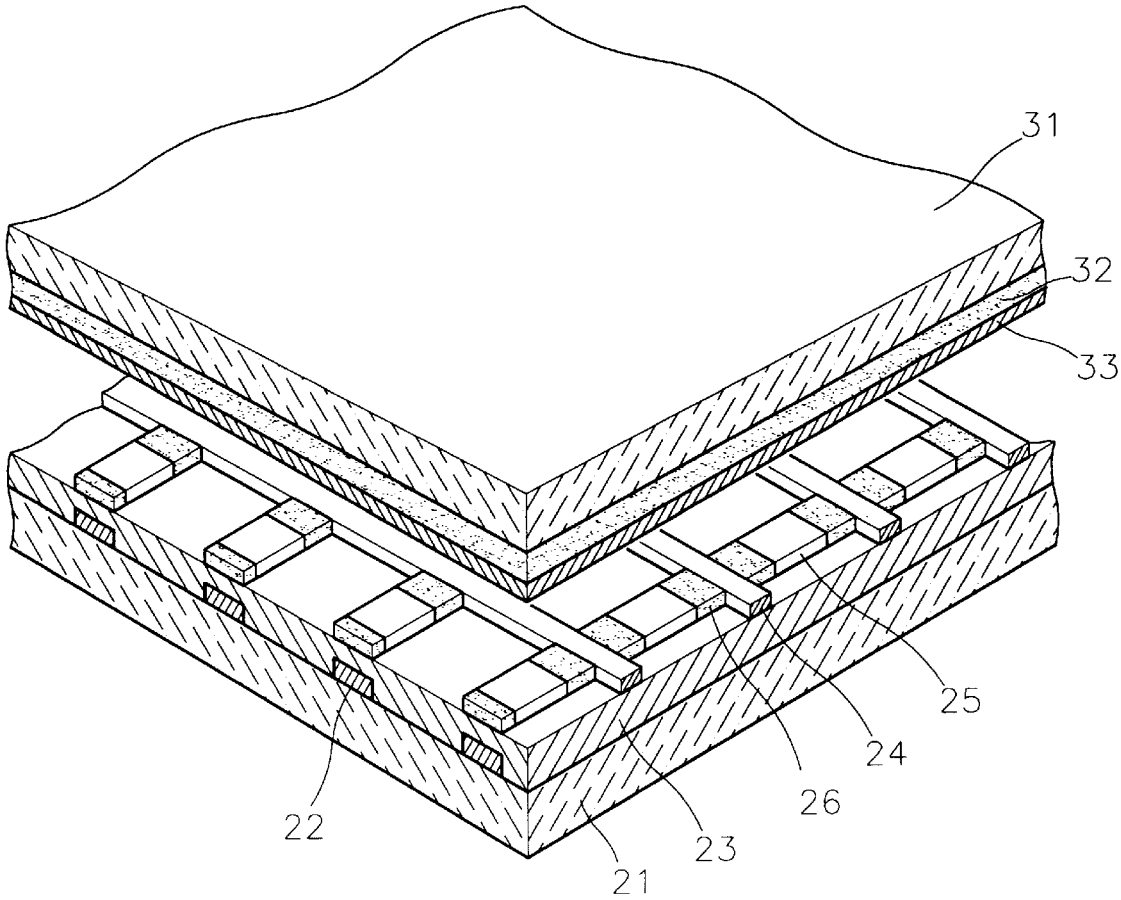
FIG. 2 is an exploded perspective view illustrating a display device using a field emission device according to the present invention.

FIG. 2 shows a display device according to the present invention. Referring to FIG. 2, a phosphor layer 32 and an accelerating electrode layer 33 are sequentially deposited on the inner surface of a front substrate 31, and a field emission device 20 is coupled on the bottom surface of the front substrate 31 to form a free space through which electrons move.

The field emission device 20 includes a substrate 21, a first electrode 22 formed on the upper surface of the substrate 21 in a predetermined pattern, a dielectric layer 23 formed on the substrate 21 and the first electrode 22 to embed the first electrode 22 therein, and a second electrode 24 formed on the dielectric layer 23 in a predetermined pattern. The second electrode 24 is preferably formed to be orthogonal with the first electrode 22. Also, the first and second electrodes 22 and 24 are preferably formed by printing an Ag or Al paste.

A floating electrode 25 is formed on the dielectric layer 23 to be spaced apart from the second electrode 24. Also, a conductive particle layer 26 for electrically connecting the second electrode 24 with the floating electrode 25 is provided between the second electrode 24 and the floating electrode 25.

The conductive particle layer 26 is formed by coating a paste obtained by mixing metal particles with graphite and hardening the same. Thus, conductive particles of the conductive particle layer 26, i.e., metal particles, are dispersed in the paste. The distance between the first electrode 22 and the floating electrode 25 can vary according to the size of a conductive particle and the concentration of the paste.

The capacitance between the first electrode 22 and the floating electrode 25 is preferably greater than that between the first electrode 22 and the second electrode 24.

An alternating voltage is applied between the first and second electrodes 22 and 24, a voltage higher than the alternating voltage applied to the first and second electrodes 22 and 24 is applied to the accelerating electrode layer 33.

The operation of the display device having the above-described configuration according to the present invention will now be described.

If a predetermined alternating voltage is applied between the first and second electrodes 22 and 24, no potential is applied to the floating electrode 25. However, a voltage difference between the second electrode 24 and the floating electrode 25 is generated due to a capacitive coupling effect of the floating electrode 25 so that current flows through the conductive particle layer 26 between the second electrode 24 and the floating electrode 25. At this time, electrons are emitted from conductive particles dispersed in the conductive particle layer 26 by a tunneling effect. In other words, electrons are emitted from a plane.

The field emission device 20 driven by the alternating voltage may generate a leakage current. Since the capacitance between the first electrode 22 and the floating electrode 25 is greater than that between the first electrode 22 and the second electrode 24, the generation of leakage current can be minimized.

As described above, the electrons emitted from the field emission device 20 are accelerated by the accelerating electrode layer 33 formed on the front substrate 31 facing the field emission device 20 and strikes the phosphor layer 32 to excite phosphors, thereby forming an image.

As described above, according to a field emission device of the present invention and a display device using the same, since first and second electrodes, and a floating electrode are printed on the substrate 21 using an Ag or Al paste, and a conductive particle layer can be formed by printing a conductive power containing paste on the floating electrode 25, a large display device can be fabricated. Also, since the second electrode 24 and the floating electrode 25 can be formed by printing a paste containing conductive particles whose size and concentration are controlled between the second electrode 24 and the floating electrode 25, and heating the same, the distance between electrodes can be easily adjusted.

While the present invention has been described with reference to illustrative embodiments by way of examples only, it should be understood that various changes and equivalent embodiments may be made by those skilled in the art. It is therefore contemplated that the true scope of the invention be set forth in the appended claims.

What is claimed is:

1. A field emission device comprising:

a substrate;

a first electrode formed on the substrate in a predetermined pattern;

a dielectric layer formed on the substrate to embed the first electrode;

a second electrode formed on the dielectric layer in a predetermined pattern;

a floating electrode spaced apart a predetermined distance from the second electrode, on the dielectric layer; and a conductive particle layer formed between the second electrode and the floating electrode to electrically connect the second electrode and the floating electrode.

2. The field emission device according to claim 1, wherein the conductive particle layer is formed by hardening a paste containing conductive particles so that the conductive particles are dispersed and spaced apart from one another.

3. The field emission device according to claim 1, wherein the capacitance between the first electrode and the floating electrode is greater than that between the first electrode and the second electrode.

4. A display device comprising:

a field emission device including a substrate, a first electrode formed on the substrate in a predetermined pattern, a dielectric layer formed on the substrate to embed the first electrode, a second electrode formed on the dielectric layer in a predetermined pattern, a floating electrode spaced apart a predetermined distance from the second electrode, on the dielectric layer, and a conductive particle layer formed between the second electrode and the floating electrode to electrically connect the second electrode and the floating electrode; and a front substrate coupled in front of the substrate to form a space for electron emission with the substrate and having a phosphor layer and an accelerating electrode layer sequentially formed in its inner surface.

5. The display device according to claim 4, wherein the conductive particle layer is formed by hardening a paste containing conductive particles so that the conductive particles are dispersed and spaced apart from one another.

6. The display device according to claim 4, wherein the capacitance between the first electrode and the floating electrode is greater than that between the first electrode and the second electrode.

* * * * *